US005428853A

United States Patent [19]

Menke et al.

[11] Patent Number: 5,428,853

[45] Date of Patent: Jul. 4, 1995

[54] FIREMAN'S COMBINATION TOOL ASSEMBLY

[75] Inventors: W. Kenneth Menke; W. Kenneth Menke, III, both of Glendale, Mo.

[73] Assignee: The Ahrens-Fox Fire Engine Company, Webster Groves, Mo.

[21] Appl. No.: 175,304

[22] Filed: Dec. 29, 1993

[51] Int. Cl.[6] ..... B25F 1/00

[52] U.S. Cl. ..... 7/138; 7/166/143; 81/164; 81/175

[58] Field of Search ..... 7/138, 139, 142, 166, 7/170, 143; 29/275; 30/367; 81/155, 158, 164, 175, 176.3, 125; 254/114, 120

[56] References Cited

U.S. PATENT DOCUMENTS

| | | | |
|---|---|---|---|
| 297,838 | 4/1884 | Parsons . | |
| 510,981 | 12/1893 | Massey . | |
| 585,123 | 6/1897 | Severance . | |
| 685,356 | 10/1901 | Sommerfeld | 7/138 |
| 1,126,678 | 2/1915 | Apfeld . | |
| 1,397,644 | 11/1921 | McChesnie . | |
| 1,460,294 | 6/1923 | Wegner . | |
| 1,527,772 | 2/1925 | Baird . | |
| 1,608,432 | 11/1926 | Ryan | 81/164 |
| 1,763,353 | 6/1930 | Heller . | |
| 1,784,535 | 12/1930 | Osterby . | |
| 1,936,359 | 11/1933 | Huthsing et al. . | |
| 2,723,581 | 11/1955 | Schwaiger . | |
| 4,114,216 | 9/1978 | Gatby . | |
| 4,268,926 | 5/1981 | Roxton . | |
| 4,597,123 | 7/1986 | Cobe, Jr. . | |
| 4,646,378 | 3/1987 | Borden . | |

*Primary Examiner*—D. S. Meislin

*Attorney, Agent, or Firm*—Rogers, Howell & Haferkamp

[57] ABSTRACT

A fireman's personal hand tool is comprised of a spike member and a wrench member. Both members may be used in combination as a slide hammer with the spike member being hammered by the wrench member between objects to be pried apart. The wrench member may also be used to open or close valves and is configured to fit a variety of hydrant valve head shapes and sizes. Both the spike member and the wrench member have integral hose coupling jaws to engage and disengage hose couplings. The members are separable so that the jaws may be used independently or in combination. In addition, there are three different sizes of jaws to enable the tool to fit a greater variety of coupling sizes.

17 Claims, 1 Drawing Sheet

FIREMAN'S COMBINATION TOOL ASSEMBLY

BACKGROUND OF THE INVENTION

1. Field of the Invention

The present invention pertains to a fireman's combination tool assembly. In particular, the present invention pertains to a fireman's personal hand tool comprising a spike member and a wrench member. Both members may be used in combination as a slide hammer with the spike member being hammered by the wrench member between objects to be pried apart. The wrench member may also be used to open or close valves and is configured to fit a variety of hydrant valve head shapes and sizes. Both the spike member and the wrench member have integral hose coupling jaws to engage and disengage hose couplings. The members are separable so that the jaws may be used independently or in combination. In addition, there are three different sizes of jaws to enable the tool to fit a greater variety of coupling sizes.

2. Description of the Related Art

In fighting a fire, firemen must perform many tasks requiring a variety of tools. For example, firemen must frequently force open locked doors to gain access to buildings or rooms, they frequently are required to engage or disengage hose couplings, and to open or close valves, such as hydrant and gas valves, having a variety of valve head designs. These tasks require a variety of different tools which are both heavy and large because they must be durable and strong. Historically, fire departments divided these tasks among different groups of men allowing them to carry only the specific tools they needed. However, due to reduced manpower, these tasks can no longer be divided and every firefighter must either carry many tools or make frequent trips back to the truck to collect the specific tools required for a particular task.

Gaining access into a locked building historically required two or more firefighters using large, heavy tools. The typical tools included an axe, a sledgehammer, and a pry bar. Because these tools are too large and heavy to be carried as personal tools, they had to be removed from the truck upon discovering that a door to a room or building was locked. Frequently, this required a second trip causing wasted time and energy of the firefighters.

Engaging and disengaging hose couplings is a routine practice for firefighters. Hose couplings are used at the hydrant, at the pumper truck and/or at the stand pipe. They are used at the junction of two fire hoses and at the connection between the nozzle and the fire hose. Each of these couplings must be tightly engaged to reduce leakage and prevent unintentional disengagement, thereby unleashing potentially dangerous energy. Thus, tools with hose coupling jaws are required to engage and disengage the hose couplings. Typically in the past, firefighters have carried only one such tool compatible with 1 ½ to 2 ½-inch hose couplings. However, normally two tools are required to tightly engage a hose coupling and it is not infrequent that couplings larger than 2 ½-inches in diameter are encountered. Thus, firefighters were forced to either carry potentially unnecessary equipment or make frequent trips back to the truck for additional equipment. Either alternative wasted the firefighter's energy and time.

Firefighters frequently encounter a variety of valves having different valve heads. For instance, the valve head of a fire hydrant is typically pentagon-shaped to discourage vandalism, gas main shut-off valve heads are typically rectangular, and stand pipe valve heads are typically hand wheels with spokes. Due to the infrequent use of each of these valves, it is not uncommon for them to become frozen requiring leverage to either open or close them. In addition, the dimensions of the valve heads are not necessarily standard, therefore the number of wrenches required to turn the many different varieties of valve heads is increased to the point of precluding firefighters from carrying a separate wrench for each possible valve head. Thus, the firefighter must return to the truck each time a new valve head is encountered, thereby taking time and energy from the firefighter.

In an effort to overcome these aforementioned disadvantages, some prior art firefighter's tools combined more than one tool together. For example, the U.S. Patent of Heller U.S. Pat. No. 1,763,353 discloses a combination tool with a hose coupling spanner on one end and a cam wrench on the other for opening pentagon-headed valves. However, this tool did not incorporate any means of prying objects apart, for example for opening locked doors, and it was designed to fit pentagon-shaped valve heads; rectangular valve heads required a separate tool. In addition, the tool only had one hose coupling spanner in one size and required an additional tool when two spanners were needed to tighten or loosen hose couplings.

Another example of a prior art combination tool is disclosed in the U.S. Patent of Cobe, Jr. U.S. Pat. No. 4,597,123. This tool combined several commonly used firefighting tools including a pry bar. However, a separate hammer or sledge was required to hammer the pry bar tip between objects, and it provided only one hose coupling jaw in one size. It also did not have a wrench to turn hydrant valve heads.

Still another example of prior art combination tools is disclosed in the U.S. Patent of Borden U.S. Pat. No. 1,784,535 which describes a tool having hose coupling spanners, a pentagon-shaped box wrench, a pry bar and a scaling hook. This tool was designed to fit only one size pentagon valve head, and a separate tool was required to apply impact loading to the wedge to force open locked doors.

And finally, another example of a prior art combination tool is disclosed in U.S. Pat. No. 4,646,378. This tool is a combination of a pry bar, a hose coupling jaw and a rectangular-shaped box wrench. This tool was also designed to fit only one type of valve head shape. In addition, the tool incorporated only one hose coupling jaw in one size. Although the tool was designed to be used as a pry bar, a separate hammer or sledge was needed to hammer the tool into a gap such as may be required when forcing open a locked door.

SUMMARY OF THE INVENTION

The present invention is a combination tool which overcomes the aforementioned disadvantages associated with prior art fireman's tools by providing an adjustable wrench capable of fitting a variety of hydrant valve head shapes in different sizes and applying leverage to the valves to open or close them. The tool further comprises a spike with a prying tip in combination with a means for applying impact loading thereto for prying objects apart with the spike, and a plurality hose coupling jaws in a variety of sizes which may be used independently from one another for engaging and disengaging hose couplings in a variety of sizes.

The combination tool of the present invention is generally constructed in two parts which may be separated from one another. The two parts include a spike member and a wrench member. These members may used in combination or separately depending upon the task at hand.

The spike member is comprised of a hollow tubular handle with a spike or prying tip and a hose coupling jaw at one end, and an opening to the interior of the tubular handle at its opposite end. The handle can be used to apply leverage to the spike when being used as a pry bar, or to the hose coupling jaw when engaging or disengaging hose couplings. The spike member handle is tubular for two reasons. First, the handle is tubular so that a rod shaped handle of the wrench member can be inserted and reciprocated inside the hollow interior of the spike member handle to form a slide hammer for applying impact loads to the spike tip. Second, the spike handle is tubular to allow the wrench handle to fit inside its interior to form an extension of the handle for applying additional leverage to the spike tip or spanner.

The spike or prying tip of the spike member can be used to force entry through locked building doors by chopping or prying at the door or by hammering the tip between the door and its jamb using the slide hammer feature. Thus, where an axe, a sledgehammer and a pry bar were once required, this invention combines their functions into one compact unit.

The wrench member is comprised of a solid rod handle with an adjustable wrench and two opposing hose coupling jaws of different sizes at one end of the handle. As with the spike member handle, the wrench member handle is used to apply leverage when using the member as a wrench or hose coupling jaw. The adjustable wrench is configured to accept a variety of pentagonal and rectangular valve head shapes and sizes. Thus, where many wrenches were once required, the present invention universally fits most valve heads found in firefighting.

Together, the spike member and wrench member provide several hose coupling jaws in a variety of sizes so that a greater variety of hose coupling sizes may be accommodated. The spike and wrench members may be disassembled from one another so that the jaws of each may be worked independently of one another.

By incorporating the several improved features recited above, the fireman's combination tool of the present invention overcomes disadvantages commonly associated with prior art fireman's tools.

BRIEF DESCRIPTION OF THE DRAWING FIGURES

Further objects and features of the present invention are revealed in the following detailed description of the preferred embodiment of the invention and in the drawing figures wherein.

Figures 1, 2, 3, 4, 5, 6, 7, 8:
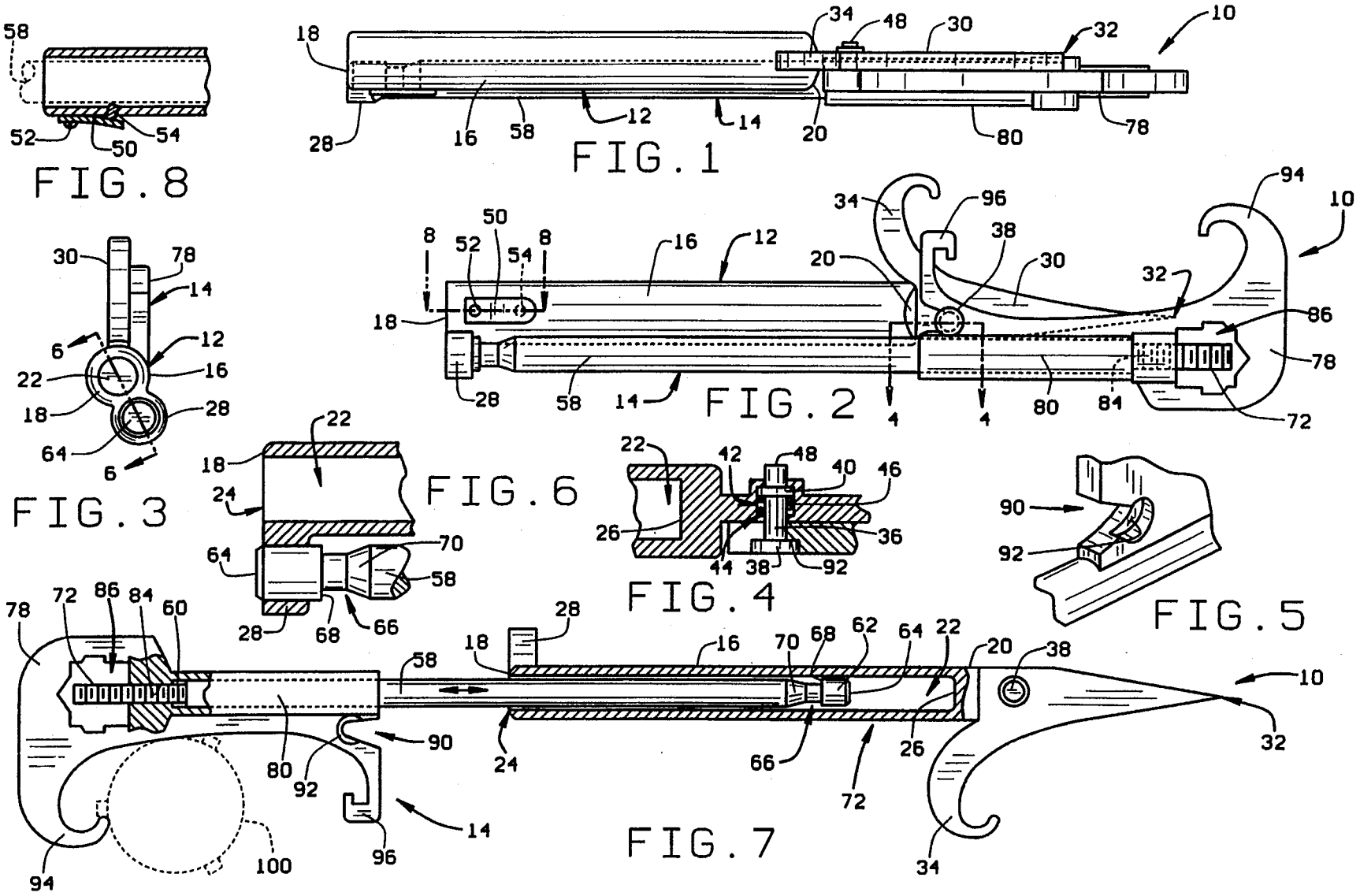
FIG. 1 is a top plan view of the fireman's combination tool assembly of the present invention in its connected storage or transport configuration of the spike and wrench members of the tool.
FIG. 2 is a side view of the fireman's combination tool assembly in the connected storage and transport configuration.
FIG. 3 is an end view of the fireman's combination tool assembly in the connected storage and transport configuration as shown in FIGS. 1 and 2.
FIG. 4 is a partial cross-sectional view taken along the plane of line 4—4 in FIG. 2, detailing the means for locking the spike and wrench members together in the storage and transport configuration.
FIG. 5 is a partial view of the wrench member of the present invention showing details of the connector mechanism for retaining the invention in the connected storage and transport configuration.
FIG. 6 is a partial cross-sectional view of the combination tool taken along the plane of line 6—6 in FIG. 3, detailing the retention ring for holding the combination tool assembly in the connected storage and transport configuration.

FIG. 7 is a side view in partial section of the fireman's combination tool assembly of the present invention showing the tool in its slide hammer configuration with a cross-section of a hose coupling shown in phantom; and, FIG. 8 is a partial cross-sectional view taken along the plane of line 8—8 of FIG. 2, detailing the safety catch mechanism for preventing inadvertent disassembly of the combination tool while in the slide hammer configuration with the wrench member partially shown in phantom.

DETAILED DESCRIPTION OF THE PREFERRED EMBODIMENT

As shown in FIG. 7, the firemen's combination tool assembly 10 is comprised of a spike member 12 and a wrench member 14. Both members are preferably constructed entirely of metal and each member is about 20 inches in length so that both may be carried by a firefighter without adding an uncomfortable amount of weight to the equipment being carried by the firefighter. Although the combination tool is described herein as being primarily a firefighter's tool, it should be understood that this is not intended to be limiting but only an illustration of the use of the tool.

The spike member 12 includes an elongated tubular handle 16 having opposite first 18 and second 20 ends, or left and right hand ends as viewed in drawing FIG. 7. A hollow interior bore 22 extends through the length of the tubular handle 16 and terminates at an opening 24 provided at the first end of the handle and a strike surface 26 provided in the interior bore at the second end of the handle. A retaining ring 28 is secured to the exterior surface of the handle adjacent its first end, and a spike head 30 is secured to the second end of the handle.

The spike head 30 is formed as a generally planar member that extends longitudinally from the tubular handle second end 20 and tapers to a prying tip 32 projecting from the handle second end 20. A hose coupling jaw 34 extends from the side of the spike head 30 adjacent the handle second end 20. The jaw 34 has a configuration that enables it to be attached over at least a portion of the circumference of a conventional fire hose coupling thereby enabling the length of the tubular handle 16 to be used as a lever in turning the fire hose coupling.

Also mounted to the spike head 30 is a post 36 having a circular head 38 and an annular collar 40 formed thereon. As best seen in FIG. 4, the post 36 is received in a cavity 42 formed in the spike head and is retained within the cavity by an annular shoulder 44 surrounding the post. A coil spring 46 in the cavity 42 between the post collar 40 and annular shoulder 44 biases the post to its at-rest position shown in FIG. 4. By manually depressing the distal end 48 of the post from the post head 38, the post head can be extended away from the side of the spike head 30. The spring biased post 36 is employed in releasably connecting the spike member 12 and wrench member 14 together as will be explained.

As best seen in FIG. 8, a flexible metal strip 50 is secured to the exterior surface of the tubular handle adjacent its first end 18. The strip 50 is secured to the tubular handle at one end of the strip by a rivet 52, and a pin 54 secured to the underside of the strip extends through a hole in the tubular handle and projects into the handle interior bore 22. The strip 50 is resilient so that it biases the pin 54 through the hole and into the handle interior bore 22, but also may be manually deflected back from the handle to retract the pin 54 through the hole and out of the handle interior bore 22. The functions served by the strip and pin will be described later.

The wrench member 14 has a rodlike handle 58 with longitudinally opposite first 60 and second 62 ends. The rodlike handle 58 has a longitudinal length greater than the longitudinal length of the tubular handle interior bore 22, and has a cross sectional diameter less than the cross sectional diameter of the interior bore. This dimensioning of the rodlike handle enables it to be inserted into the tubular handle interior bore and reciprocated therethrough. The rodlike handle has a hammer surface 64 formed at its second end and an annular groove 66 formed in the handle adjacent its second end. The groove 66 is defined by an annular shoulder 68 formed in a plane perpendicular to the center axis of the rodlike handle 58 and by a tapered shoulder 70. A screw threaded stud 72 projects longitudinally from the first end 60 of the rodlike handle and is coaxial with the center axis of the handle.

A wrench head 78 is secured to the first end 60 of the rodlike handle. The wrench head has a tubular sleeve 80 thereon having an interior bore 82 with an interior diameter slightly larger than the exterior diameter of the rodlike handle 58. As shown in FIG. 7, the first end 60 of the rodlike handle is inserted through the wrench head sleeve 80 and the screw threaded stud 72 projecting from the rodlike handle first end is screwed into an internally threaded aperture 84 of the wrench head, thereby releasably attaching the rodlike handle 58 to the wrench head. The wrench head 78 is generally a planar member as best seen in FIG. 1, and has an opening 86 extending through the wrench head on an opposite side of the internally threaded aperture 84 from the wrench head sleeve 80. The wrench head opening 86 has a configuration that enables it to receive a variety of objects having different geometric configurations. This enables the wrench head opening 86 to be used in turning a variety of differently shaped objects as will be explained.

A slot 90 is formed extending into the wrench head 78 on an opposite side of the wrench head from the wrench head opening 86. The slot 90 tapers as it extends into the wrench head and terminates at a circular depression 92 formed in one side of the wrench head. The circular depression 92 is dimensioned to receive the post head 38 of the spike member post in releasably connecting the spike member to the wrench member as will be explained.

Two opposing hose coupling jaws 94, 96 are also formed on the wrench head 78. As seen in FIG. 7, one hose coupling jaw 96 is smaller than the other 94 and is configured slightly different than the other so that a greater variety of hose coupling configurations can be engaged by the three hose coupling jaws provided by the wrench member and spike member. In the preferred embodiment of the invention as shown in FIG. 7, the larger hose coupling jaw 94 is positioned adjacent the end of the wrench head 78 opposite its connection to the rodlike handle 58 so that the rodlike handle provides the greatest leverage in using the larger hose coupling jaw.

FIGS. 1 to 4 and 6 show the spike member 12 and wrench member 14 releasably connected together for transport or storage of the two members of the combination tool assembly. In connecting the spike member and wrench member together, the two members are initially positioned with their respective handles side by side and the hammer surface 64 of the rodlike handle 58 adjacent to the retaining ring 28 of the tubular handle 16, and with the spring biased post 36 of the spike member adjacent the mouth of the slot 90 formed in the wrench member head 78. The two members are then moved longitudinally relative to each other inserting the second end 62 of the rodlike handle into the retaining ring 28 of the tubular handle while simultaneously moving the spike member post 36 into the wrench head slot 90. As the spike member post 36 is moved into the wrench head slot 90, the post distal end 48 is manually depressed against the bias of the coil spring 46 to extend the post head 38 out from the spike head 30. The spike member post is held in this position until the post head 38 is positioned over the depression 92 formed at the end of the wrench head slot 90. When the post head 38 is positioned over the slot depression 92, the post end 48 is released, causing the coil spring 46 to pull the post head 38 into the slot depression 90 and thereby securing the spike member and wrench member in their relative positions shown in FIGS. 1 and 2. With the spike member and wrench member held together in their positions shown in FIGS. 1 and 2, they will not inadvertently come apart from each other and may be easily transported. To disassemble the two members from each other, one need only depress the spike member post distal end 48 causing the post head 38 to extend from the slot depression 92, enabling the two members to be moved longitudinally relative to each other to disengage the members from each other for use.

As best seen in FIGS. 1 and 2, with the spike member 12 and wrench member 14 of the tool assembly connected together by the retaining ring 28 and spring biased post 36, the prying tip 32 of the spike member is substantially shielded by the wrench head 78 to reduce the potential for injury to the user of the tool assembly during transport. In this configuration, the tool may either be hand carried, placed in a fireman's coat pocket, or suspended from a hook on a belt through the wrench head opening 86.

The tool assembly 10 of the invention may be used in several different ways, one use being to gain access to locked rooms or buildings. With the spike member 12 separated from the wrench member 14, a user may grasp the handle 16 of the spike member to use the prying tip 32 to chip or ram through a wood door, break open a window, or even break through a wall of a building. The prying tip 32 of the spike member may be used to pry apart two objects, for example a padlock hasp and a door locked by the padlock, or a door and door jamb to pry open a locked door.

To assist in driving the prying tip 32 of the spike member 12 between two objects, the spike member and wrench member may be assembled together in the relative positions shown in FIG. 7 to form a slide hammer with the two members that is used to drive the prying tip between two objects. In the assembled positions of the spike member 12 and wrench member 14 shown in FIG. 7, the rodlike handle 58 of the wrench member may be reciprocated manually through the interior bore of the spike member tubular handle 16 causing the hammer surface 64 of the rodlike handle to strike repeatedly against the strike surface 26 of the spike member interior bore. The impact force of the wrench member hammer surface 64 against the spike member strike surface 26 is transmitted through the spike head 30 to the prying tip 32 and functions to drive the tip between two objects separating the two objects. As seen in FIG. 8, with the wrench member rodlike handle 58 inserted in the interior bore of the spike member tubular handle 16, the pin 54 is displaced from the spike member interior bore 22 against the resiliency or bias of the strip 50. However, if the rodlike handle 58 is pulled almost entirely out of the interior bore 22, the pin 54 is biased by the strip 50 to engage in the annular groove 66 adjacent the second end of the rodlike handle, thereby preventing the rodlike handle from being inadvertently pulled completely out of the spike member interior bore. The resilient strip 50 biasing the pin 54 into the spike member interior bore 22 prevents the wrench member 14 from inadvertently falling out of the spike member interior bore 22 when the tool assembly is being transported in its assembled configuration shown in FIG. 7, and also prevents the user of the tool assembly from inadvertently pulling the wrench member rodlike handle 58 out of the spike member interior bore 22 on an upstroke while using the tool as a slide hammer, thereby avoiding injury to the tool's user during the following downstroke. To fully separate the spike member from the wrench member when assembled in the configuration shown in FIG. 7, the user merely holds the pin 54 in its retracted position by holding the deflected strip 50 in its position shown in FIG. 8, thereby enabling the wrench member rodlike handle to be withdrawn from the spike member interior bore.

In a variant embodiment of the invention, the handles of the spike member and wrench member may be reversed with the spike member having a rodlike handle and the wrench member having a tubular handle. However, this configuration is less desirable than the preferred embodiment described herein, because providing the spike member with the tubular handle enables a user of the tool assembly to hold the tubular handle steady while reciprocating the wrench member rodlike handle through the tubular handle interior bore.

The wrench head 78 of the wrench member 14 may be used to turn a variety of differently shaped objects, for example pentagon or rectangular shaped hydrant valve heads, hydrant hose coupling caps, or gas shut-off valve heads. As best seen in FIG. 7, by rotating the rodlike handle 58 counterclockwise relative to the wrench head 78 the threaded stud 72 is withdrawn from the wrench head opening 86. The opening 86 may then be positioned over the object desired to be turned by the wrench member 14. With the wrench head opening 86 positioned over the object, the rodlike handle 58 is then turned clockwise relative to the wrench head 78 causing the stud 72 to move to the left as viewed in FIG. 7, and securely clamp the object to be turned by the wrench head in the wrench head opening. The rodlike handle 58 of the wrench member provides additional leverage in turning objects with the wrench head. For still further leverage, the spike member tubular handle 16 may be assembled over the rodlike handle 58.

The hose coupling jaw 34 of the spike member and the two hose coupling jaws 94, 96 of the wrench member may be used to turn a variety of different sized hose couplings by connecting the jaws to a portion of the exterior surface of the coupling in the manner shown in FIG. 7. FIG. 7 shows a representation of a conventional hose coupling 100 engaged by the larger of the two hose coupling jaws 94 of the wrench member. Connecting the wrench member to the hose coupling in this manner provides the added leverage of the rodlike handle 58 in turning the hose coupling. It should be understood that the hose coupling jaw 34 of the spike member and the smaller hose coupling jaw 96 of the wrench member may be connected to a conventional hose coupling in the same manner as the hose coupling jaw 94 shown in FIG. 7. Furthermore, both the spike member and wrench member hose coupling jaws may be used together to rotate a pair of hose couplings that are connected to each other.

The opposed hose coupling jaws 94, 96 of the wrench member may also be used to open or turn stand pipe valve hand wheels. The opposed jaws 94, 96 may be inserted between spokes of the valve wheel and engaged against the spokes thereby enabling the rodlike handle 58 to be used as a lever in turning the valve wheel. The configuration of the wrench head coupling jaws enables the wrench head to apply more force in turning the valve head wheel with less risk of the wrench member slipping off of the wheel and thereby potentially causing injury to the user of the tool assembly.

While the present invention has been described by reference to a specific embodiment, it should be understood that modifications and variations of the invention may be constructed without departing from the scope of the appended claims.

What is claimed is:

1. A combination hand tool assembly comprising:

a spike member, the spike member having a tubular handle with opposite first and second ends and a hollow interior bore extending through the tubular handle from an opening to the bore at the tubular handle first end, to a strike surface in the bore at the tubular handle second end, the spike member also having a prying tip projecting from the tubular handle second end; and, a wrench member, the wrench member having a rodlike handle with opposite first and second ends, the rodlike handle having a configuration for inserting the rodlike handle through the interior bore of the tubular handle to engage the second end of the rodlike handle against the strike surface of the tubular handle with the first end of the rodlike handle projecting from the opening at the first end of the tubular handle, whereby the rodlike handle may be manually reciprocated in the tubular handle bore to apply impact forces to the strike surface and the prying trip of the spike member, and the rodlike handle having at its first end means for wrenching objects of different configurations therewith, wherein the spike member and the wrench member have means thereon for selectively connecting the spike member and wrench member together with the tubular handle and the rodlike handle in side-by-side relative positions.

2. The tool assembly of claim 1, wherein:

the spike head has a hose coupling jaw thereon, the jaw having a configuration for manually engaging the jaw over at least a portion of a circumference of a hose coupling and thereby attaching the spike member to the hose coupling for leveraged turning of the hose coupling with the spike member.

3. The tool assembly of claim 2, wherein:

the means for wrenching objects includes a wrench head secured to the first end of the rodlike handle, the wrench head having at least one hose coupling jaw thereon, the one jaw having a configuration for manually engaging the one jaw over at least a portion of a circumference of a hose coupling and thereby attaching the wrench member to the hose coupling for leveraged turning of the hose coupling with the wrench member.

4. The tool assembly of claim 3, wherein:

the wrench head has a pair of hose coupling jaws thereon.

5. The tool assembly of claim 1, wherein:

the means for wrenching objects includes a wrench head secured to the first end of the rodlike handle, the wrench head having adjustable means for securing objects of different configurations to the wrench head for turning of an object secured to the wrench head by the wrench member.

6. The tool assembly of claim 5, wherein:

the rodlike handle has a screw threaded stud at its first end, the stud has a distal end from the rodlike handle with a contact surface thereon;

the wrench head has a screw threaded aperture thereon through which the stud of the rodlike handle is received, and the wrench head has at least a pair of contact surfaces thereon configured for engagement of the pair of contact surfaces with objects of different configurations for securing the objects to the wrench head, the stud contact surface be opposed by the pair of contact surfaces whereby rotation of the rodlike handle relative to the wrench head results in rotation of the stud within the aperture and adjustment of the stud contact surface relative to the pair of contact surfaces.

7. The tool assembly of claim 1, wherein:

the means for selectively connecting the spike member and wrench member includes a post provided on one of the spike member and the wrench member and a slot formed in the other of the spike member and the wrench member, where the slot is configured to receive the post therein and thereby connect the spike member to the wrench member.

8. A combination hand tool assembly comprising:

a spike member, the spike member having a handle and a spike head secured to the handle, the spike head having a prying tip thereof projecting from the handle;

a wrench member, the wrench member having a handle and a wrench head secured to the handle, the wrench head having means thereon for wrenching objects of different configurations therewith; and, the spike member and the wrench member having means thereon for selectively connecting the spike member and wrench member together in side-by-side relative positions, and for separating the spike member from the wrench member, wherein one of the spike member and the wrench member handles is a tubular handle with opposite first and second ends and a hollow interior bore extending therethrough from an opening of the bore at the handle first end to a strike surface in the bore at the handle second end; and, the other of the spike member and wrench member handles is a rodlike handle with opposite first and second ends and having a configuration for inserting the rodlike handle through the tubular handle bore to impact the second end of the rodlike handle against the strike surface of the tubular handle, whereby the rodlike handle may be manually reciprocated in the tubular handle bore to apply impact forces to the strike surface and the prying tip of the spike member.

9. A combination hand tool assembly comprising:

a spike member, the spike member having a handle and a spike head secured to the handle, the spike head having a prying tip thereon projecting from the handle;

a wrench member, the wrench member having a handle and a wrench head secured to the handle, the wrench head having means thereon for wrenching objects of different configurations therewith; and, the spike member and the wrench member having means thereon for selectively connecting the spike member and wrench member together in side-by-side relative positions, and for separating the spike member from the wrench member, wherein both the spike head and the wrench head have at least one hose coupling jaw thereon, each hose coupling jaw has a configuration for manually engaging the jaw over at least a portion of a circumference of a hose coupling thereby attaching the jaw to the hose coupling for leveraged turning of the hose coupling.

10. The tool assembly of claim 9, wherein:

the means for selectively connecting the spike member to the wrench member includes a post on one of the spike member and wrench member and a slot on the other of the spike member and the wrench member, the slot having a configuration for receiving the post therein and thereby connecting the spike member to the wrench member.

11. The tool assembly of claim 10, wherein:

the post has a head formed thereon and is mounted in a cavity in the one of the spike member and wrench member, and means are provided in the cavity for resiliently biasing the post into the cavity and for enabling the post to be manually extended from the cavity in opposition to the means for biasing the post; and, the slot extends to a depression formed in the other of the spike member and wrench member, the depression having a configuration to receive the post head therein and thereby connect the spike member to the wrench member.

12. The tool assembly of claim 9, wherein:

the wrench head is provided with at least first and second mutually opposed contact surfaces and means for adjusting a relative spacing between the first and second contact surfaces for gripping objects between the first and second contact surfaces and rotating the objects by rotating the wrench member.

13. A combination hand tool comprising:

a longitudinal handle assembly having opposite first and second ends, the second end having a prying tip thereon projecting longitudinally from the handle assembly and the first end having a wrench head thereon, the wrench head having at least first and second mutually opposed contact surfaces and means for adjusting a relative spacing between the first and second contact surfaces for gripping objects between the first and second contact surfaces and turning the objects by manual manipulation of the handle assembly, wherein at least one hose coupling jaw is connected to the handle assembly, the jaw has a configuration for manually engaging the jaw over at least a portion of a circumference of a hose coupling and thereby attaching the handle assembly to the hose coupling for leveraged turning of the hose coupling by the handle assembly.

14. The tool assembly of claim 13, wherein:

the handle assembly includes means for longitudinally reciprocating the wrench head relative to the prying tip to apply impact forces to the prying tip.

15. The tool assembly of claim 14, wherein:

the handle assembly includes a tubular handle with opposite first and second ends and a hollow interior bore extending therethrough from an opening to the bore at the tubular handle first end to a strike surface in the bore at the tubular handle second end, the prying tip projecting from the tubular handle second end; and, the handle assembly also includes a rodlike handle with opposite first and second ends, the wrench head being connected to the rodlike handle first end and the rodlike handle having a configuration for inserting the rodlike handle second end through the tubular handle bore to impact the rodlike handle second end against the tubular handle strike surface and thereby apply impact forces to the strike surface and the prying tip.

16. The tool assembly of claim 15, wherein:

at least one hose coupling jaw is connected to the tubular handle and at least one hose coupling jaw is connected to the rodlike handle.

17. The tool assembly of claim 15, wherein:

the tubular handle and the rodlike handle have means thereon for selectively connecting the tubular handle and rodlike handle together in side-by-side relative positions,

* * * * *